United States Patent [19]

Warren et al.

[11] Patent Number: 4,899,833

[45] Date of Patent: Feb. 13, 1990

[54] DOWNHOLE DRILLING ASSEMBLY ORIENTING DEVICE

[75] Inventors: Tommy M. Warren, Coweta; Warren J. Winters, Tulsa, both of Okla.

[73] Assignee: Amoco Corporation, Chicago, Ill.

[21] Appl. No.: 281,293

[22] Filed: Dec. 7, 1988

[51] Int. Cl.[4] ..... E21B 7/08

[52] U.S. Cl. ..... 175/45; 175/48; 175/61; 175/73

[58] Field of Search ..... 175/25, 38, 45, 48, 175/61, 62, 73; 166/250

[56] References Cited

U.S. PATENT DOCUMENTS

| | | | |
|---|---|---|---|
| 3,983,948 | 10/1976 | Jeter . | |
| 4,171,578 | 10/1979 | Meador . | |
| 4,220,213 | 9/1980 | Hamilton | 175/45 |
| 4,276,943 | 7/1981 | Holmes | 175/40 |
| 4,305,474 | 12/1981 | Farris et al. . | |
| 4,319,649 | 3/1982 | Jeter . | |
| 4,465,147 | 8/1984 | Feenstra et al. . | |
| 4,699,224 | 10/1987 | Burton . | |

FOREIGN PATENT DOCUMENTS

| | | | |
|---|---|---|---|
| 911242 | 5/1954 | Fed. Rep. of Germany | 175/45 |
| 1205068 | 9/1970 | United Kingdom | 175/45 |

OTHER PUBLICATIONS

Marshall, "Survey Steering Tool: The Ultimate for Saving Rig Time", SPE 5897, (1976).

*Primary Examiner*—William P. Neuder

*Attorney, Agent, or Firm*—Scott H. Brown; Fred E. Hook

[57] ABSTRACT

The orientation of a downhole steering assembly used in drilling a horizontal well is located with respect to the earth using a sub placed above the downhole assembly. The sub comprises a housing having a central bore defining an inlet flow passageway said housing further defining a toroidal chamber in communication with said passageway. The toroidal chamber has a pocket, a valve seat, and a spherical valve that is rotatable in said toroidal chamber from a normally seated position in the pocket. Upon rotation of the drill string the spherical valve plugs the valve seat and causes an increase in the resistance to flow in the drilling mud through the drill string that can be detected at the surface.

11 Claims, 2 Drawing Sheets

DOWNHOLE DRILLING ASSEMBLY ORIENTING DEVICE

FIELD OF THE INVENTION

This invention relates to a method and apparatus for horizontal drilling. More specifically, the invention relates to orienting a downhole drilling assembly including a steering tool assembly.

BACKGROUND OF THE INVENTION

During the drilling of subterranean wellbores, the upper portion of the drill string is composed of drill pipe which is operated under tension, the lower portion of the drill string is generally composed of drill collars whose weight is applied to the drill bit thereby placing the collars in compression, and torque is applied to the entire drill string in order to rotate the drill bit. Accordingly, the weight of the drill collars in compression can be resolved into two component forces: a first acting parallel to the axis of the collars and a second acting normal to the first, perpendicular to the wellbore. Similarly, the load applied by the drill bit to the rock can be resolved into axial and normal component forces. The loads transmitted to the drill bit by the lowermost collars and the drill string affect the magnitude and direction of the forces applied by the drill bit to the rock.

If during drilling the magnitude and direction of the normal forces in the vicinity of the drill bit can be controlled, then theoretically the bit can be steered and caused to drill in any desired subsurface location.

Various processes and associated equipment have been developed to both enhance and minimize this normal force. In regard to minimizing the normal force, various types of drill collars, stabilizers and the like, has been used to continuously restore the borehole to vertical. For example, U.S. Pat. No. 4,319,649 discloses drill collar stabilizers to maintain the drill string in a vertical direction. In U.S. Pat. No. 4,220,213, there is described placing an eccentric member having a thickwalled side and a lighter side concentrically about a drill collar to maintain drilling in the vertical direction. In this method, gravity will cause the thick-walled portion of the eccentric collar to rotate to the low side of the deviated drill string.

Various types of drill collar stabilizers have also been used to alter the direction of drilling. U.S. Pat. Nos. 4,305,474 and 4,465,147 disclose stabilizers that create a force perpendicular to the drill string in order to steer the drill bit along a desired direction.

One type of drilling process that is particularly difficult to control is called horizontal drilling. Horizontal drilling involves creating a highly curved wellbore having a tight radius and curvature. This type of drilling can be characterized by a rate of change of angle on the order of 0.5–6°/ft, resulting in radii of curvature of 10–120 ft and a final drift angle of about 90°.

In U.S. Pat. No. 4,699,224, there is disclosed a method of horizontal drilling using a flexible drill string connected by a flexible joint to a drill bit collar equipped with a stabilizer, and rotary drill bit. This method includes the use of an eccentric cylindrical collar having a sidewall engaging means that circumferentially mounts to the downhole end of the flexible drill string directly over the flexible joint leading to the drill bit collar. This eccentric collar forces the drill string passing therethrough to one side of the wellbore, thus lever arming the drill bit to the other side of the wellbore by pivoting on a stabilizer mounted to the drill bit collar between the flexible joint and the drill bit.

Although with the aid of the borehole engaging means the cylindrical eccentric collar is designed not to rotate with the drill string, friction between the collar and drill string plus downhole vibrations occurring during drilling will tend to rotate the collar, thereby resulting in the need for the collar to be reoriented periodically while drilling the curve from vertical to horizontal.

One alternative would be to mark the pipe as it is being introduced into the wellbore, and once in the wellbore, rotate the drill string counterclockwise, stopping at the correct orientation, the surface pipe mark. Although this method can be used in shallow wells, an alternative method is needed to orient the collar in deeper wells due to the unpredictable twist of the drillstring.

One method of orienting the eccentric collar would be to use a steering tool as disclosed in Marshall, *Survey Steering Tool: The Ultimate for Saving Rig Time*, SPE 5897 (1976), but this would be expensive because it would require a wireline truck and associated equipment.

Another method would be to use a single-shot orientation survey, for example, the device described in U.S. Pat. No. 4,171,578. The disadvantage of this method is the time required to introduce the instrument into the wellbore for each survey.

The accuracy of both the steering tool and the single-shot survey methods would be limited by the torsional flexibility of the drill collars since the orientation sub would have to be located above the drill collars because the internal diameter of the collars is not sufficient for the survey tool to pass through.

In U.S. Pat. No. 3,983,948, there is disclosed a tool for indicating the orientation of a downhole drilling assembly. This tool is undesirable because it is complicated with many intricate parts susceptible to breakdown in the harsh borehole environment. Further, the tool is not amenable to compact packaging for use in small diameter wellbores, for example, of less than 6 in. in diameter. Therefore, the tool is not appropriate for high curvature or horizontal holes. Moreover, this tool appears to be limited to drilling with a downhole motor.

There is a need for a simple device with minimal moving parts for orienting a downhole drilling assembly used in building angle during horizontal drilling. There is a novel need for a compact device for use in orienting downhole drilling assemblies, including a steering tool assembly that anticipates use in boreholes that have high curvature.

SUMMARY OF THE INVENTION

One aspect of this invention is a method for indicating at the earth's surface when a drilling assembly connected to a drill string located in a wellbore is in a preselected orientation with respect to the earth. The method comprises pumping drilling fluid down the drill string while rotating the drill string in a first direction, and changing resistance to flow of the drilling fluid in the drill string to create an increase in said resistance to indicate that a downhole assembly is in a preselected orientation relative to the earth. The increase can be accomplished using a sub located in the drill string above the steering assembly. The sub is activated by rotation of the drill string in a second direction that is opposite to the first direction. The downhole drilling assembly can include a steering assembly including an eccentric cylindrical collar means having a cylindrical hole passing therethrough wherein the central axis of the cylindrical hole is colinear with and displaced radially to one side relative to the central axis of the eccentric cylindrical collar means. The eccentric collar means can be equipped with a radially extending borehole engaging means that operatively engages the borehole during rotary drilling.

Another aspect of this invention is a method for orienting a drill bit steering assembly. The method comprises pumping drilling fluid down the drill string while drilling in a first direction, ceasing the rotation of the drill string in the first direction and rotating the drill string in a second direction opposite the first direction until a rise in pump pressure is detected at the surface, ceasing the flow of drilling fluid and rotating the drill string in the first direction, and pumping the drilling fluid down the drill string and continuing to drill.

Another aspect of this invention is an apparatus for indicating at the earth's surface when a downhole drilling assembly connected to a drill string having a drilling fluid flowing therethrough is in a given orientation relative to the earth. The apparatus is a sub placed in the drill string above the downhole drilling assembly. The sub is capable of increasing the resistance to the flow of drilling fluid through the drill string in response to rotation of the drill string. The sub can comprise a housing having a central bore defining an inlet flow passageway and a toroidal chamber in communication with said passageway. The toroidal chamber can have a pocket and a valve seat. The housing further defines a bifurcated outlet flow passageway, said bifurcated outlet flow passageway including an elongated outlet flow passageway in communication with the inlet flow passageway and including a valve seat outlet flow passageway in communication with said valve seat. The sub also contains a spherical valve being rotatable in said toroidal chamber from a normally seated position in the pocket. The toroidal chamber can define a ball race or an arcuate edge that is coaxial with the central bore. The bottom surface of the toroidal chamber can have irregular projections on either side of the valve seat to prevent the ball plugging the valve seat prematurely. The elongated outlet passageway can be in substantial coaxial alignment with the inlet flow passageway. The downhole steering assembly can include an cylindrical collar means defining a cylindrical hole passing therethrough, said cylindrical hole having a central axis colinear with and displaced radially to one side relative to the central axis of said collar means, and wherein the outer surface of the collar is equipped with a borehole engaging means. The valve seat can be located on the low side of the borehole. The ball moves out of its normally seated position in the pocket and rotates along the toroidal chamber in response to rotation of the drill string, thereby plugging the valve seat and increasing the resistance to the flow of drilling fluid through the drill string.

DESCRIPTION OF THE PREFERRED EMBODIMENT

Figure 1:
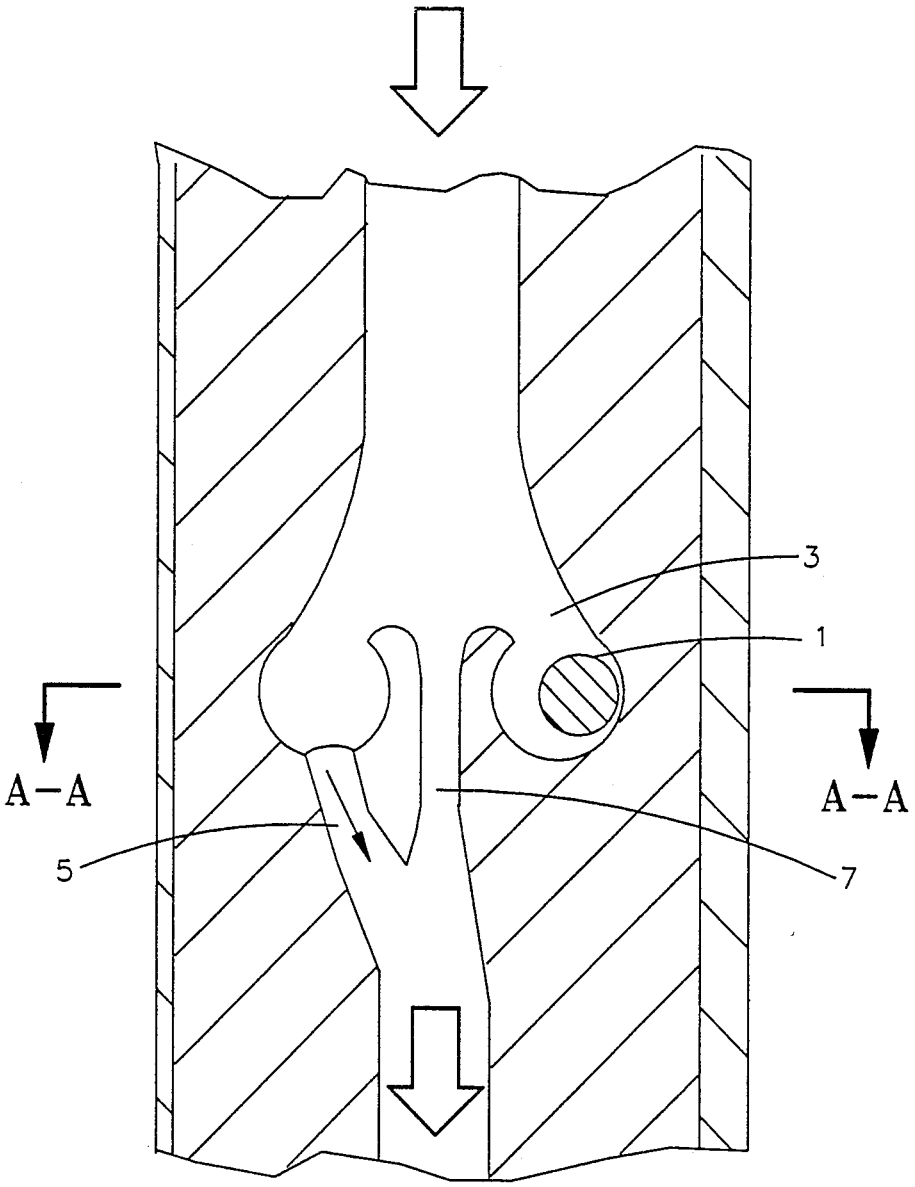
FIG. 1 is an axial sectional view of a preferred embodiment of the apparatus of this invention.
Figure 2:
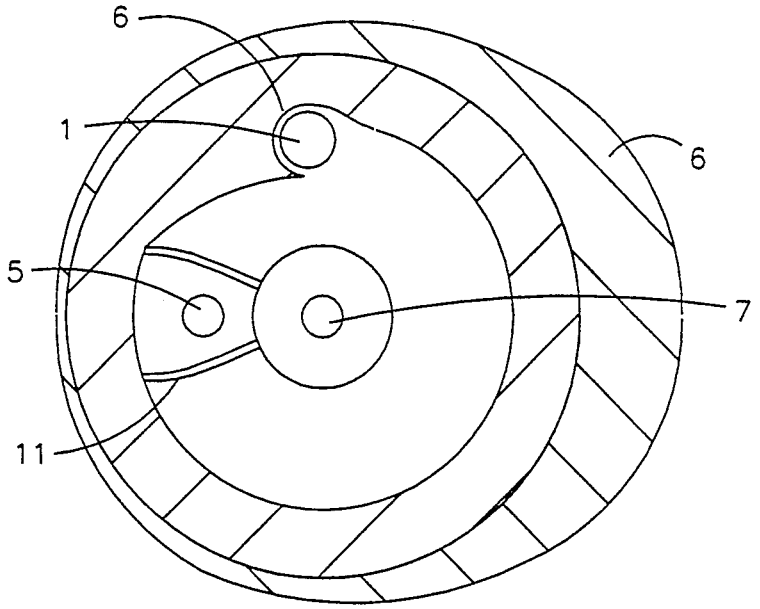
FIG. 2 is a circumferential sectional view of the apparatus of FIG. 1 taken along line A—A.

Referring to FIGS. 1 and 2, the downhole steering assembly orienting device comprises a dense ball 1 in a ball race 3 that can seal an off-centered port 5 through which drilling fluid flows. The ball race 3 is only one embodiment of the toroidal chamber The invention encompasses any toroidal chamber, for example, an arcuate edge. The race 3 can be spiraled so that two revolutions of the drill string would be required to move the ball 1 from a pocket 9 to the off-centered port 5.

The drilling assembly orienting device, which can be incorporated into a sub placed directly above a downhole steering assembly (not shown), contains two ports for passage of drilling fluid. The center port 7 is designed for the primary flow of drilling fluid and the off-center port 5 is used to provide a detectable resistance in the flow of drilling fluid when the off-center port 5 is on the low side of the borehole and a selected part of the steering assembly is on the high side of the borehole. The high side of the borehole is defined as the region in a given cross section taken perpendicular to the axis of the wellbore nearest the surface of the earth, that is, opposite to the direction of the earth's gravitational force. The two ports, 5 and 7, can be sized so that a detectable increase in the surface drilling fluid pump pressure is generated when the off-centered port 5 is plugged while the total drilling fluid pumping pressure does not become excessive.

The off-center port 5 should be located on the low side of the borehole. Where the downhole drilling assembly includes a steering assembly including an eccentric collar 6 having a borehole engaging means, for example as shown in U. S. Pat. No. 4,699,224, the off-center port 5 can be located 180° opposite the angular position of the borehole engaging means.

The ball 1 is normally located in a pocket 9 when the drill string is rotate clockwise during normal drilling operations and is therefore incapable of plugging the center flow port 7. However, if the drill string is rotated counterclockwise, the ball 1, due to gravity, will stay on the low side of the hole and will plug the off-center port 5 when the port 5 also reaches the low side. As soon as the port 5 is plugged, the pump pressure will increase, thus indicating at the surface that the borehole engaging portion of the eccentric collar is properly oriented to the high side of the borehole.

Irregular projections 11 can be incorporated into the ball race 3 on either side of the port 5 to prevent premature plugging of the port 5 by the ball 1 due to forces caused by the flowing fluid. Proper design of the irregular projections 11 should result in the port 5 being repeatably plugged within a tolerance of ±5° of the true low side.

Another method for using the apparatus of this invention to reorient a downhole assembly, for example, the eccentric collar described in U.S. Pat. No. 4,699,224, by initially orienting the eccentric collar 6 using a conventional single-shot instrument as described in U.S. Pat. No. 4,171,578, then drill approximately 5–10 ft with stops made each foot to reorient the eccentric collar such that the borehole engaging means is on the high side of the wellbore. This reorientation is accomplished by rotating the drillstring slowly counterclockwise until a rise in pump pressure is detected at the surface. The rise in pump pressure indicates that the eccentric collar is properly oriented with the borehole engaging means adjacent the high side of the wellbore i.e., that the borehole engaging means is adjacent the high side of the deviated borehole. The pump is then shut down and the drill string rotated one revolution clockwise to remove the ball 1 from the port 5. The pump is then restarted and drilling is resumed.

After drilling about 30% of the curve, the single-shot instrument is run to determine that the well is headed in the proper direction. If the direction should need to be corrected, the proper tool face is determined using known art and the eccentric collar is positioned at the proper orientation relative to the high side of the hole using the apparatus of the this invention. A second check of the hole direction is made after drilling an additional 5–10 ft. In this way, the number of trips for the survey tool into the well is minimized while at the same time the correct direction is assured.

What is claimed is:

1. A method for indicating at the earth's surface when a steering assembly connected to a drill string located in a wellbore is in a preselected orientation with respect to the earth, comprising:

(a) pumping drilling fluid down the drill string while rotating the drill string in a first direction; and (b) changing resistance to the flow of the drill fluid in the drill string to create a constant increase in said resistance to indicate that the steering assembly is in a preselected orientation relative to the earth, wherein step (b) further comprises rotating the drill string in a second direction that is opposite to the first direction to activate a sub located in the drill string above the steering assembly, and wherein the steering assembly is an eccentric cylindrical collar having a hole passing therethrough, and having a radially extending borehole engaging means for operatively engaging the borehole during rotary drilling.

2. An apparatus for indicating at the eartth's surface when a downhole steering assembly connected to a drill string is in a given orientation relative to the earth, comprising:

a sub for placement in the drill string above the steering assembly for increasing the resistance to the flow of drilling fluid through the drill string in response to rotation of the drill string, the sub further comprising a housing having a central bore defining an inlet flow passageway, said housing further defining a toroidal chamber in communication with said passageway, said toroidal chamber having a pocket and a valve seat, said housing further defining a bifurcated outlet flow passageway, said bifurcated outlet flow passageway including an elongated outlet flow passageway in communication with said inlet flow passageway and including a valve seat outlet flow passageway in communication with said valve seat; and a spherical valve being rotatable in said toroidal chamber from a normally seated position in said pocket.

3. An apparatus of claim 2 wherein the toroidal chamber defines a ball race.

4. An apparatus of claim 2 wherein the elongated outlet flow passageway is in substantial coaxial alignment with the inlet flow passageway.

5. An apparatus of claim 1 wherein the toroidal chamber is coaxial with the central bore.

6. An apparatus of claim 2 wherein a bottom surface of the toroidal chamber has irregular projections on either side of the valve seat to prevent the ball from plugging the valve seat prematurely.

7. An apparatus of claim 2 wherein the downhole drilling steering assembly includes an eccentric cylindrical collar means defining a cylindrical hole passing therethrough, and wherein the outer surface of said collar is equipped with a borehole engaging means.

8. An apparatus of claim 7 wherein the valve seat is located on a low side of the borehole.

9. An apparatus of claim 7 wherein the valve seat is located 180° from the borehole engaging means.

10. An apparatus of claim 9 wherein the spherical valve moves out of its normally seated position in the pocket and rotates along the toroidal chamber in response to rotation of the drill string thereby plugging the valve seat and increasing the resistance to the flow of drilling fluid through the drill string.

11. A method for orienting a drilling steering assembly connected to a drill string, comprising:

(a) pumping drilling fluid through the drill string while rotating in a first direction;

(b) ceasing the rotation of the drill string in the first direction and rotating the drill string in a second direction until a rise in the drilling fluid pump pressure is detected at the surface created by a sub located in the drill string, said sub positioned in the drill string above the steering assembly, said sub comprising a housing having a central bore defining an inlet flow passageway, said housing defining a toroidal chamber in communication with said passageway, said toroidal chamber having a pocket and a valve seat, said housing further defining a bifurcated outlet flow passageway, said bifurcated outlet flow passageway including an elongated outlet flow passageway in communication with said inlet flow passageway and including a valve seat outlet flow passageway in communication with said valve seat, and a ball valve being rotatable in said toroidal chamber from a normally seated position;

(c) ceasing the flow of drilling fluid and rotating the drill string in the first direction; and (d) pumping drilling fluid through the drill string and drilling ahead.

* * * * *